US005315210A

United States Patent [19]

Lien

[11] Patent Number: 5,315,210

[45] Date of Patent: May 24, 1994

[54] KLYSTRON RESONANT CAVITY OPERATING IN $TM_{01X}$ MODE, WHERE X IS GREATER THAN ZERO

[75] Inventor: Erling L. Lien, Los Altos, Calif.

[73] Assignee: Varian Associates, Inc., Palo Alto, Calif.

[21] Appl. No.: 882,141

[22] Filed: May 12, 1992

[51] Int. Cl.[5] ..... H01J 25/00

[52] U.S. Cl. ..... 315/5.39; 333/230

[58] Field of Search ..... 315/5.39; 333/227, 230

[56] References Cited

U.S. PATENT DOCUMENTS

| | | | |
|---|---|---|---|
| 3,376,524 | 4/1968 | Wang | 315/5.39 X |
| 3,725,721 | 4/1973 | Levin | 315/5.39 X |
| 4,100,457 | 7/1978 | Edgcombe | 315/5.39 X |
| 4,168,451 | 9/1979 | Kageyama et al. | 315/5.39 |
| 4,286,192 | 8/1981 | Tanabe et al. | 315/5.41 |
| 4,629,938 | 12/1986 | Whitham | 315/5.41 |

*Primary Examiner*—Tony M. Argenbright

*Attorney, Agent, or Firm*—Bella Fishman

[57] ABSTRACT

A super-power, high voltage klystron includes an output cavity operating in the $TM_{01x}$ mode, where x is greater than zero.

31 Claims, 14 Drawing Sheets

KLYSTRON RESONANT CAVITY OPERATING IN $TM_{01X}$ MODE, WHERE X IS GREATER THAN ZERO

FIELD OF INVENTION

The present invention relates generally to resonant cavities particularly adapted for use with super-power, high voltage klystrons and, more particularly, to such a cavity operating in the $TM_{01x}$ mode, where x is greater than 0, and to a super-power, high voltage klystron including such a resonant cavity.

BACKGROUND ART

Super-power (e.g. 200 megawatts peak) klystrons operating with high voltage (e.g. 600 kV) linear electron beams are employed for various purposes, for example, as excitation sources for linear accelerators and output tubes for high power transmitters. Such klystrons require electrons having velocities in the relativistic regime.

Prior art super-power klystrons typically include an output resonant cavity structure operating in the $TM_{010}$ mode and include re-entrant drift-tubes forming interaction gaps for strong coupling to an electron beam propagating in the tube. High electric fields at metal boundaries of the interaction gap are susceptible of producing arcing. The RF voltage which can be established across the interaction gaps is thereby limited by the arcing effects. To increase the overall voltage established across the output resonant cavity structure, such structure usually includes several resonators electrically coupled together by magnetic coupling slots; such a structure is often referred to as extended interaction resonators. The extent to which the several resonators can be coupled together to increase the resonator voltage to provide the required performance in a satisfactory manner depends on internal coupling required for adequate power flow to maintain a uniform voltage distribution among the individual gaps. The success of this structure also depends on the proximity of neighboring resonant modes that affect the tube bandwidth requirements.

The prior art structures require relatively large electron beam tunnel diameters to provide the beam optics necessary for proper klystron operation, i.e. the tunnel diameter is a relatively large percentage of the diameter of the side walls of the extended interaction resonators. The large tunnel diameter is a complication in high voltage super-power klystron tubes because it increases the amount of direct electric coupling between the interaction gaps and opposes magnetic coupling through the coupling slots. Recent analysis indicates it is extremely difficult, if not impossible, to provide a super-power klystron output resonator if conventional design approaches are employed.

It is, accordingly, an object of the present invention to provide a new and improved cavity resonator particularly adapted for use as an output resonator structure in super-power klystrons.

It is another object of the invention to provide a new and improved super-power klystron operating with high-beam voltage to produce electron velocities in the relativistic regime, wherein said klystron includes a new and improved output resonator structure.

Another object of the invention is to provide a new and improved super-power, high voltage klystron having an output resonator with a relatively small peripheral volume and a low level electric field on surfaces of the resonator.

An additional object of the invention is to provide a new and improved super-power, high voltage klystron having an output cavity with a characteristic impedance compatible with the low beam impedance of such klystrons.

A further object of the invention is to provide a new and improved super-power, high voltage klystron with an output cavity having a relatively short length for the tube operating frequency.

A further object of the invention is to provide a new and improved super-power, high voltage klystron wherein the spacing between electric field peaks in the klystron resonant cavity output structure is maintained, to provide good interaction with the klystron electron beam.

BRIEF DESCRIPTION OF THE INVENTION

In accordance with one aspect of the invention, a super-power, high voltage klystron includes a resonant output cavity configured relative to the frequency of oscillations included in an electron beam of the klystron so the cavity operates in the $TM_{01x}$ mode, where x is greater than zero. Because the cavity operates in the $TM_{01x}$ mode, where x is greater than zero, the field in the cavity has a finite group velocity in the axial direction of the electron beam to provide the required power flow within the cavity with less electric field distribution distortion than is attained with the prior art $TM_{010}$ cavities.

In accordance with another aspect of the invention, a super-power, high voltage klystron includes an output cavity configured so it includes a pair of oppositely directed electric field components in the axial direction of the klystron electron beam. The oppositely directed fields have a phase velocity in the axial direction of the electron beam to provide good coupling to the beam and a lower electric field amplitude on surfaces of the cavity than is attained with the prior art $TM_{010}$ cavities.

In accordance with a further aspect of the invention, a cylindrical resonator comprises an electron beam tunnel surrounded by a cylindrical resonant cavity structure. The cylindrical resonant cavity structure is configured in the $TM_{01x}$ mode for an oscillating electron beam traversing the tunnel, where x is greater than zero.

In one embodiment, the klystron includes an electron beam tunnel upstream of the output cavity. The output cavity includes first and second adjacent sections or cells in which oppositely directed axial electric field components are derived. The first and second sections have side walls with maximum radii greater than that of the beam tunnel; the side walls are connected by a side wall segment having a minimum radius between the radius of the tunnel and the maximum radii. In one embodiment where only two such sections are provided, $x=1$. Such an arrangement causes the output cavity to have an increased characteristic impedance relative to a cavity having a constant radius side wall. In addition the resonant frequency of such a cavity is decreased relative to a cavity having a constant radius side wall for cavities having the same axial length. The resonant frequency reduction is very important to reduce axial spacing between adjacent peak field amplitudes for maximum interaction between the fields and beam.

In a preferred embodiment, x=2, in which case a third section is provided and there are first, second and third separate electric field components in the axial direction of the electron beam. The second component is between the first and third components. The first and third components have the same phase which is displaced in phase 180° from the phase of the second component. The first, second and third sections have side walls with maximum radii greater than the beam tunnel radius and which are connected together by side wall segments having a minimum radius between the radius of the tunnel and the maximum radii.

Preferably the first and third sections have lengths in the axial direction of the electron beam about half that of the second section. The total length of the three sections in the axial direction of the electron beam is preferably less than $x\lambda/2$, where $\lambda$ is the free space wavelength of oscillations induced in the output cavity by the electron beam. The first, second and third sections respectively have maximum radii of $a_1$, $a_2$, and $a_3$. At least one of $a_1$, $a_2$, and $a_3$is preferably different from remaining values thereof to control the peak magnitudes of the three electric field components. The average of $a_1$, $a_2$, and $a_3$is preferably between 0.425 $\lambda$ and 0.6 $\lambda$ to obtain the desired electrical characteristics for the resonator.

The above and still further objects, features and advantages of the present invention will become apparent upon consideration of the following detailed descriptions of specific embodiments thereof, especially when taken in conjunction with the accompanying drawings.

DESCRIPTION OF THE PREFERRED EMBODIMENTS

Figure 1:
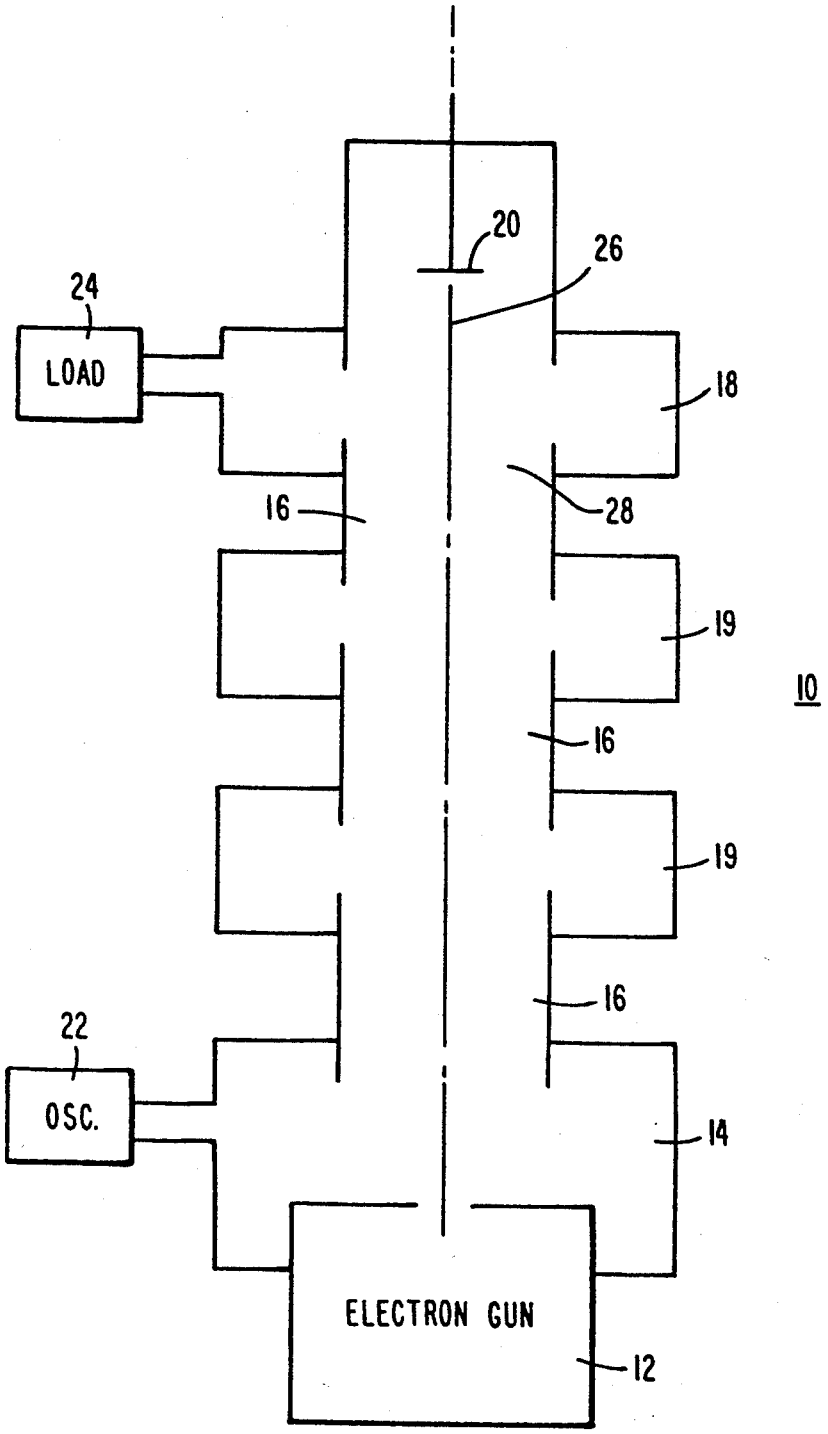
FIG. 1 is a schematic diagram of a super-power klystron.

Reference is now made to FIG. 1 of the drawing wherein super-power (e.g. 200 megawatts peak power) klystron tube 10 is illustrated as including electron gun 12, input resonant cavity 14, drift region 16, intermediate resonant cavities 19, output cavity 18 and collector 20. Gun 12 produces a high voltage, cylindrical electron beam that is accelerated to and collected by collector 20. The electron beam passes through and is coupled to resonant input cavity 14 where it is velocity modulated at the frequency of R.F. excitation source, i.e., oscillator 22. From input cavity 14, the oscillating electron beam passes through drift region 16 and intermediate resonant cavities 19 to resonant output coupling cavity 18. The entire structure of klystron tube 10 is symmetrical about tube axis 26, which is coincident with the axis of the cylindrical electron beam. The region of output cavity 18 through which the cylindrical electron beam passes is frequently referred to as electron beam tunnel 28.

Energy in output cavity 18 is coupled to an output device 24, e.g. a linear accelerator or a transmitter antenna. For certain high power applications, the electron beam derived by gun 12 is accelerated to relativistic velocities, by virtue of an excitation voltage on the order of 600 kilovolts being applied to the electron beam.

In accordance with the present invention, cylindrical output resonant cavity 18 operates in the $TM_{01x}$ mode, where x is greater than zero. In the specifically described embodiments, the output cavity operates in the $TM_{011}$ and $TM_{012}$ modes, but it is to be understood that x can have other values greater than 2. Operation in the $TM_{01x}$ mode (where x is greater than zero) implies that output cavity 18 includes an axial electric field with oppositely directed, i.e., oppositely polarized, components.

Figure 2:
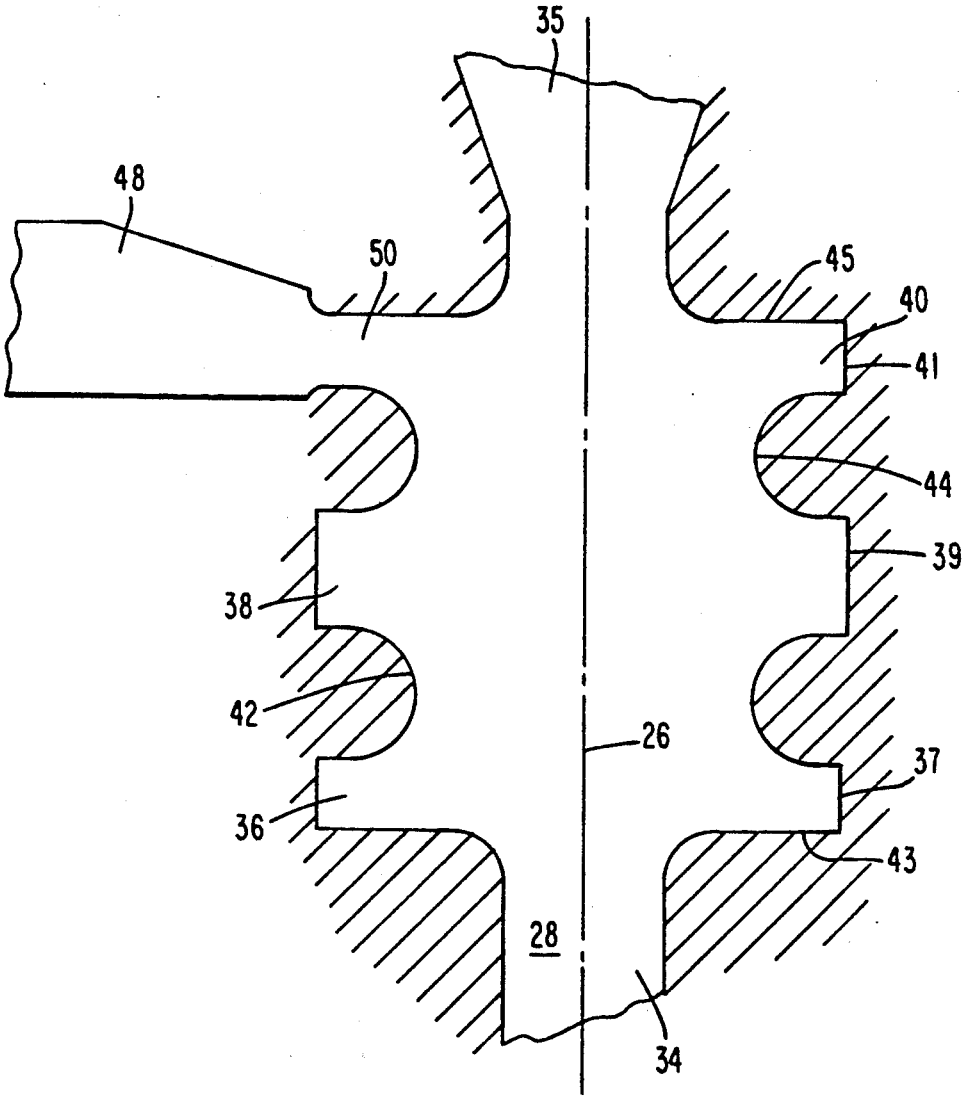
FIG. 2 is a cross-sectional view of a preferred embodiment of an output resonant cavity employed in the super-power klystron illustrated in FIG. 1.

In FIG. 2 the structure of resonant output coupling cavity 18 structure is illustrated as including cylindrical beam tunnel 28 through which the electron beam propagates from drift region 16 to collector region 35, where collector electrode 20 is located. The structure of FIG. 2 is symmetrical about beam axis 26 and includes three axially displaced cylindrical cells or sections 36, 38 and 40 which surround tunnel 28. Sections 36 and 38 are connected together by curved side wall segment 42, while sections 38 and 40 are connected together by curved side wall segment 44. Wall segments 42 and 44 have minimum radii relative to axis 26 that are about midway between the radius of tunnel 34 and the maximum radii of cylindrical side walls 37, 39 and 41 of sections 36, 38 and 40.

To couple energy from the resonant cavity structure illustrated in FIG. 2 to output device 24, wave guide 48 is inductively coupled by iris 50 to resonator section 40, in closest proximity to collector region 35.

The resonant cavity structure and wave guide 48 illustrated in FIG. 2 and the remaining figures have high conductivity conventional metal walls. In the structure of FIG. 2, the electric field at the metal walls is relatively low and there is strong electric field coupling between sections 36, 38 and 40 of the tube. In addition there is substantial coupling between the electric fields in the resonator of FIG. 2 and the electron beam propagating through tunnel 28. These advantages occur because the resonator of FIG. 2 operates in the $TM_{012}$ mode at the frequency of oscillator 22, as coupled to the electron beam traversing tunnel 28.

Figure 3:
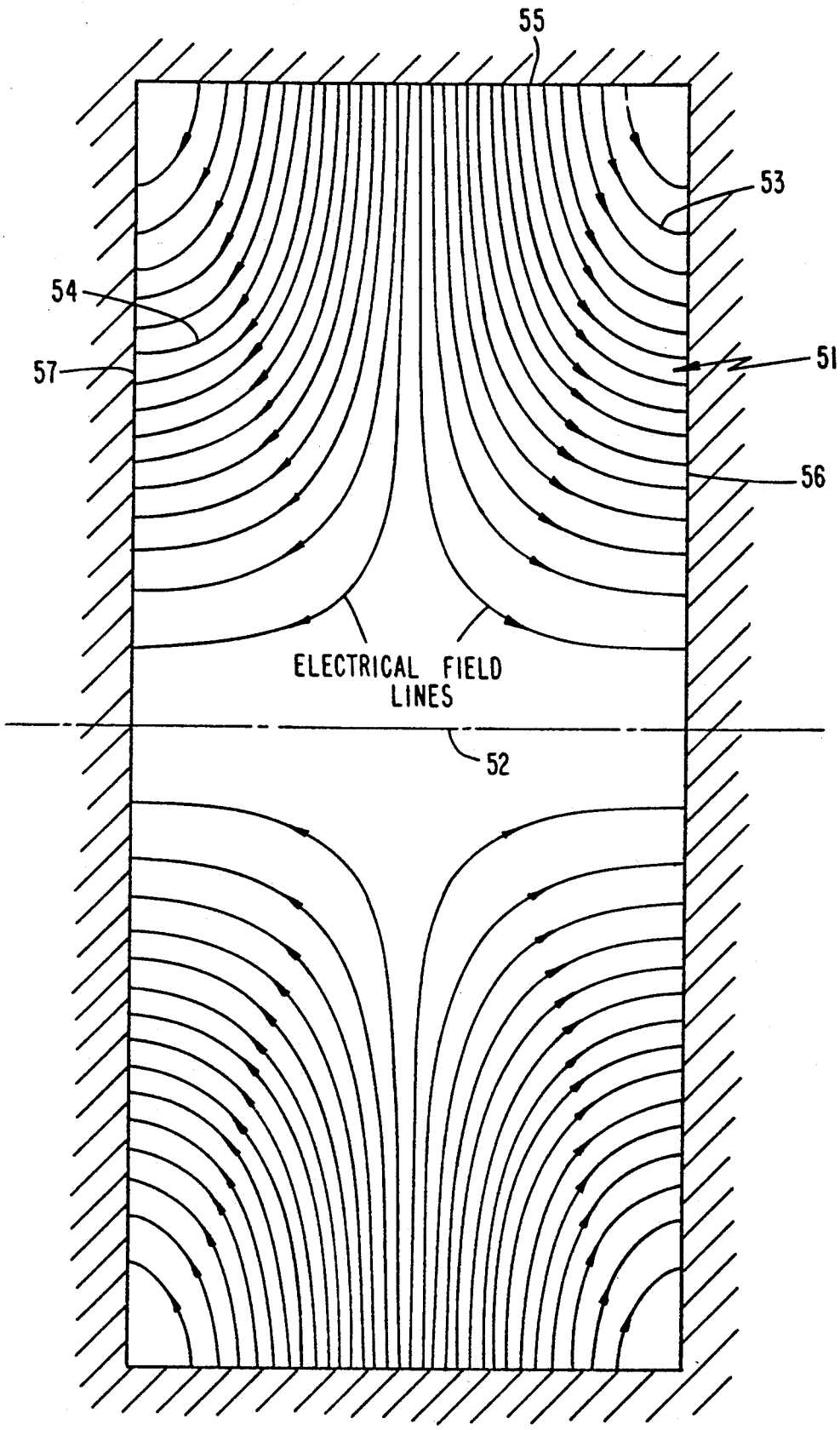
FIG. 3 is a diagram of a pill-box cavity, including electric field lines, helpful in describing the evolution of the present invention.
Figure 4:
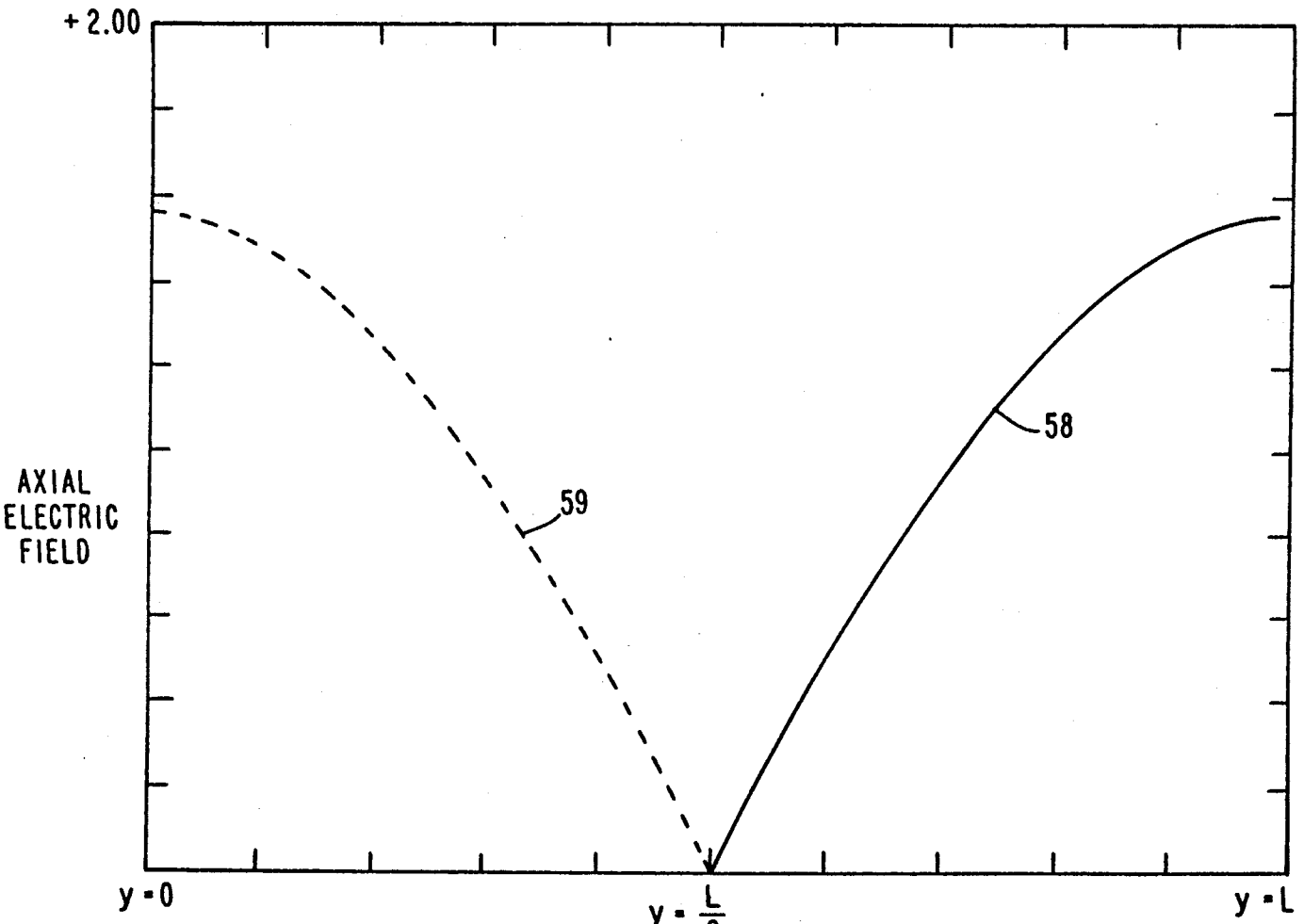
FIG. 4 is a plot of the axial electric field versus axial distance of the resonant cavity illustrated in FIG. 3.

FIG. 3 is a diagram of the structure and an indication of the electric field lines of a conventional pill box resonant cavity operating in the $TM_{011}$ mode, while FIG. 4 is a plot of the amplitude of the electric field relative to the axial direction of the resonator illustrated in FIG. 3. Resonators operating in the $TM_{011}$ mode have a finite group velocity in the axial direction of the resonator; this is in contrast to the zero group velocity in the axial direction of resonators based on the $TM_{010}$ mode. Because of this factor, there is no axial flow of energy stored in $TM_{010}$ resonant cavities.

Resonant cavity 51 of FIG. 3 has metal walls and is defined as a cylinder of revolution about center axis 52. Cavity 51 has a length in the direction of axis 52 equal to one-half wavelength of the operating frequency of the cavity. Electric field lines 53 and 54 begin on cylindrical side wall 55 and extend to opposed end walls 56 and 57 so that the electric field lines terminating on walls 56 and 57 are oppositely polarized, i.e., oppositely directed. On opposite sides of the axial bisector of cylindrical side wall 55 the electric field lines have the same polarity in the radial direction and opposite polarity in the axial direction.

FIG. 4 is a plot of the magnitude of the axial electric field of the FIG. 3 structure as a function of axial position. Axial position is represented along the abscissa axis; so that end walls 56 and 57 are indicated by the values $y=0$ and $y=L$, while the midpoint along axis 52 and side wall 55 is represented by the value $y=L/2$. When the electric field between $y=L/2$ and $y=L$ has a positive value, indicated by solid curve 58, the electric field between $y=0$ and $y=L/2$ has a negative value, indicated by dotted curve 59. The electric field has a zero value at $y=L/2$, and equal, but opposite maximum values at end walls 56 and 57, where $y=0$ and $y=L$; curves 58 and 59 are symmetrical about $y=L/2$.

In accordance with the present invention, the cavity resonator illustrated in FIG. 3 is modified to include a tunnel through which the cylindrical electron beam of the klystron of FIG. 1 propagates. Such structures are illustrated, e.g., in FIGS. 2, 5, 7, 9 and 11–14.

Figure 5:
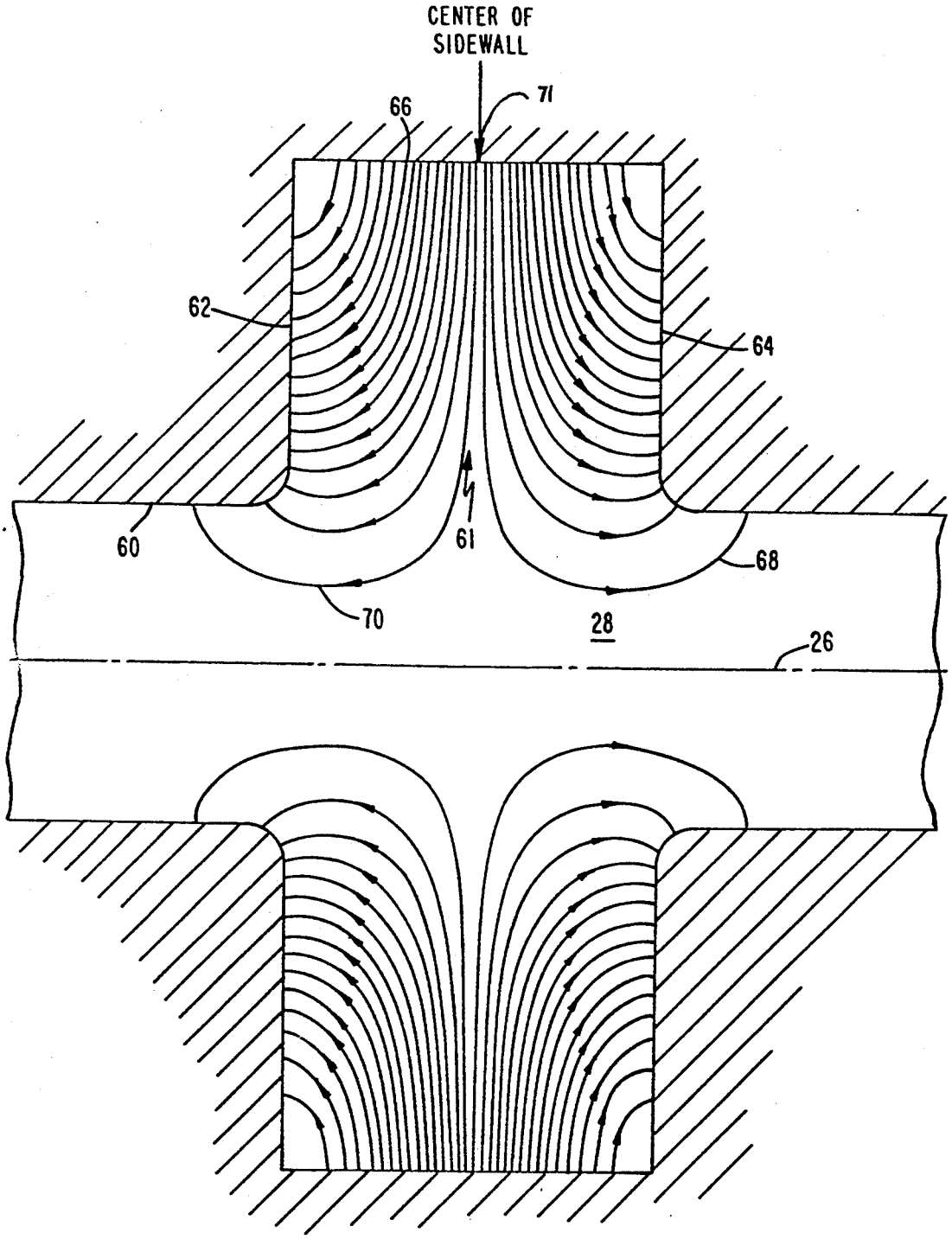
FIG. 5 is a cross-sectional view of a very simple output resonant coupling cavity that can be used in the klystron illustrated in FIG. 1.

Reference is now made to FIG. 5 of the drawing, a cross-sectional view of a very simple version of output cavity 18. Cavity 61 of FIG. 5 is a modification of the pill box cavity of FIG. 3 whereby cylindrical electron beam tunnel 28 is included therein. The cavity of FIG. 5 is configured so it is excited in the $TM_{011}$ mode for the frequency of oscillator 22.

The cavity illustrated in FIG. 5 is configured as a cylinder of revolution having an axis coincident with tube axis 26 and the axis of the cylindrical linear electron beam derived from electron gun 12. The electron beam tunnel includes cylindrical side wall 60, from which extend annular end walls 62 and 64 of the cylindrical output cavity. Resonant cavity 61 also includes cylindrical side wall 66, having a radius relative to axis 26 approximately three times that of tunnel wall 60. The dimensions of cavity 61 are such that the cavity is operated in the $TM_{011}$ mode at the output frequency of oscillator 22.

The electric field lines of cavity 61 are similar to those of the cavity of FIG. 3. In cavity 61, however, some of the electric field lines extend into tunnel 28 and terminate on tunnel side wall 60, on opposite sides of cavity end walls 62 and 64. The electric field lines ending on tunnel wall 60 on opposite sides of end walls 62 and 64 are phase displaced 180°.

Figure 6:
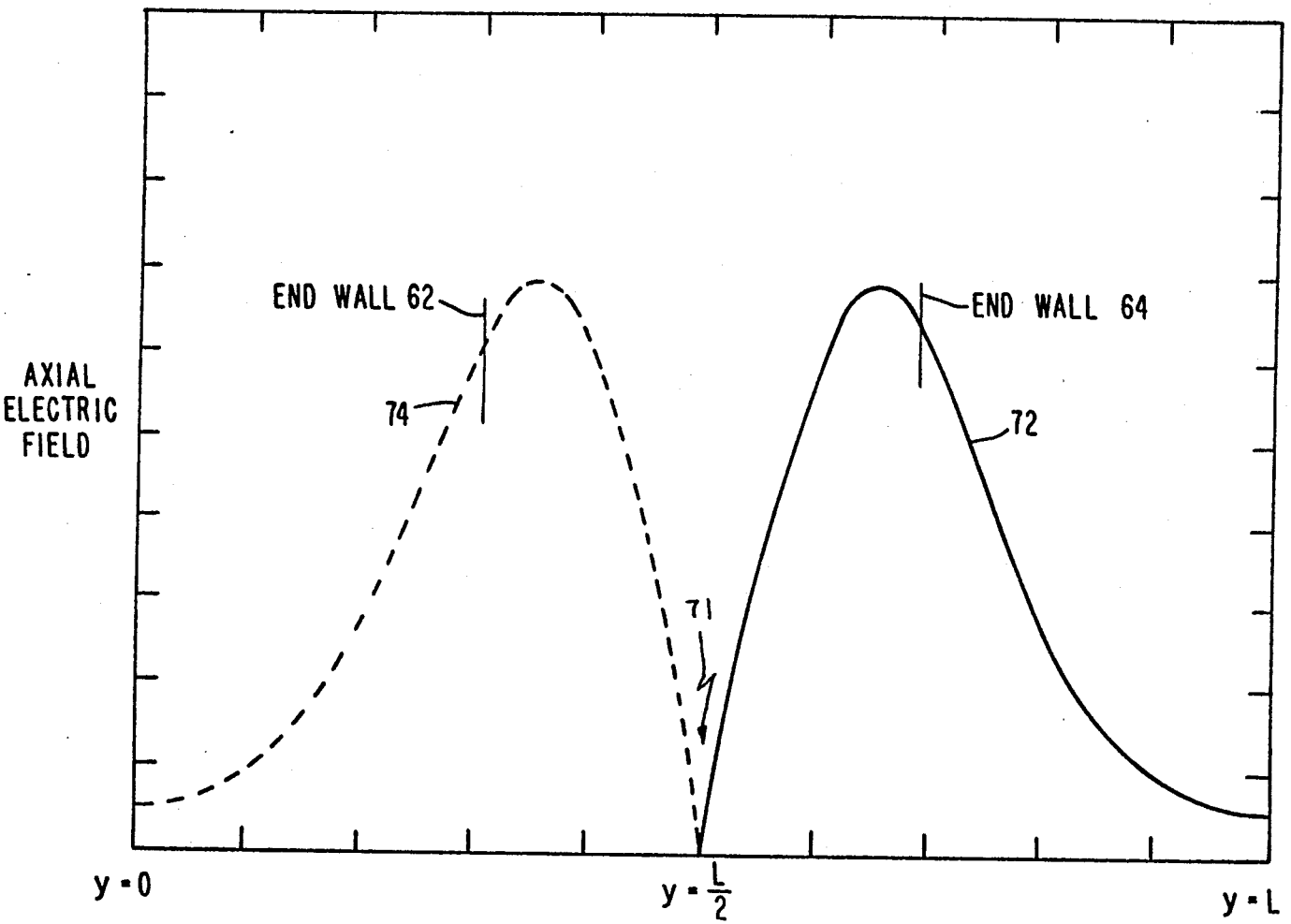
FIG. 6 is a plot of axial electric field magnitude versus axial distance for the structure illustrated in FIG. 5.

FIG. 6 is a plot of the magnitude of the axial electric field in cavity 61, as a function of axial position along the length of side wall 66 and tunnel wall 60. The magnitude of the electric field between center point 71 on side wall 66 and the upper end of the plotting range on wall 60 between cavity 61 and the collector region is represented by solid curve 72. Curve 72 has a zero value at center point 71 along side wall 66 and a peak value at a position along side wall 66 that is displaced by 0.35 L from point 71, where L is the axial length of side wall 66. The maximum indicated by curve 72 is associated with an electronic phase shift that is 1.4 times the phase shift associated with curve 58, FIG. 4, between the null and maximum values thereof. At end wall 64 the electric field amplitude decreases from the maximum value to a value that is somewhat more than 90 percent of the maximum value. At a distance equal approximately to L from point 71, the amplitude of curve 72 drops to a value of about 10% of the peak value. The amplitude of the electric field between the low end of the plotting range and point 71 is the mirror image of the amplitude of the electric field between point 71 and the high end of the plotting range, as indicated by dotted line curve 74, FIG. 6. The electric fields associated with curves 72 and 74 are phase displaced 180°, i.e., the electric field associated with curve 72 can be considered as a positive electric field, while the electric field associated with curve 74 is considered as a negative electric field.

A comparison of FIGS. 4 and 6 indicates the axial field associated with the cavity of FIG. 5 has a full period variation along axis 26, while the electric field of the cavity illustrated in FIG. 3 has a half period variation along axis 26. The curves of FIG. 4 indicate the electric field in the cavity of FIG. 3 has maximum amplitudes at end walls 56 and 57 and a null at the center of the resonant cavity. In contrast, FIG. 6 indicates that at end walls 62 and 64 of the resonant cavity illustrated in FIG. 5, there are reduced values from the peak and relatively rapid decreases in amplitude, approaching a null, beyond cavity end walls 62 and 64.

Resonant cavity 61 illustrated in FIG. 5 has a relatively low characteristic impedance, Rsh/Q, where Rsh=the equivalent shunt resistance of cavity 61, and Q=the Q or quality factor of cavity 61. Cavity 61 has relatively low value of Rsh/Q because of the large amount of electric energy stored in the relatively large volume of cavity 61 between tunnel wall 60 and side wall 66.

For many situations, it is desirable to increase the characteristic impedance of resonant cavity 18 of the super-power klystron of FIG. 1 without adversely affecting the Q of the cavity. Resonant cavity 80, FIG. 7, enables such improved performance to be attained. Resonant cavity 80 includes two separate cells or sections 82 and 84, partially spaced from each other by indented side wall 86, having a radius relative to axis 26 that is between electron beam tunnel side wall 60 and the maximum radius of cylindrical side walls 96 and 98 at the peripheries of sections 82 and 84. In one preferred configuration, side walls 96 and 98 have equal radii of R, connecting side wall 86 has a minimum radius of about R/2, and tunnel wall 60 has a radius of R/3. The resonant cavity illustrated in FIG. 7 operates in the $TM_{011}$ mode at the output frequency of oscillator 22.

Sections 82 and 84 of resonant cavity 80 respectively include cavity end walls 88 and 90 and intermediate radially extending walls 92 and 94, between which is located side wall segment 86. Intersections between walls 88 and 90 and wall 60 and between wall segments 86, 92 and 94 are curved to avoid a possible tendency for arc breakdown within the cavity.

Figure 7:
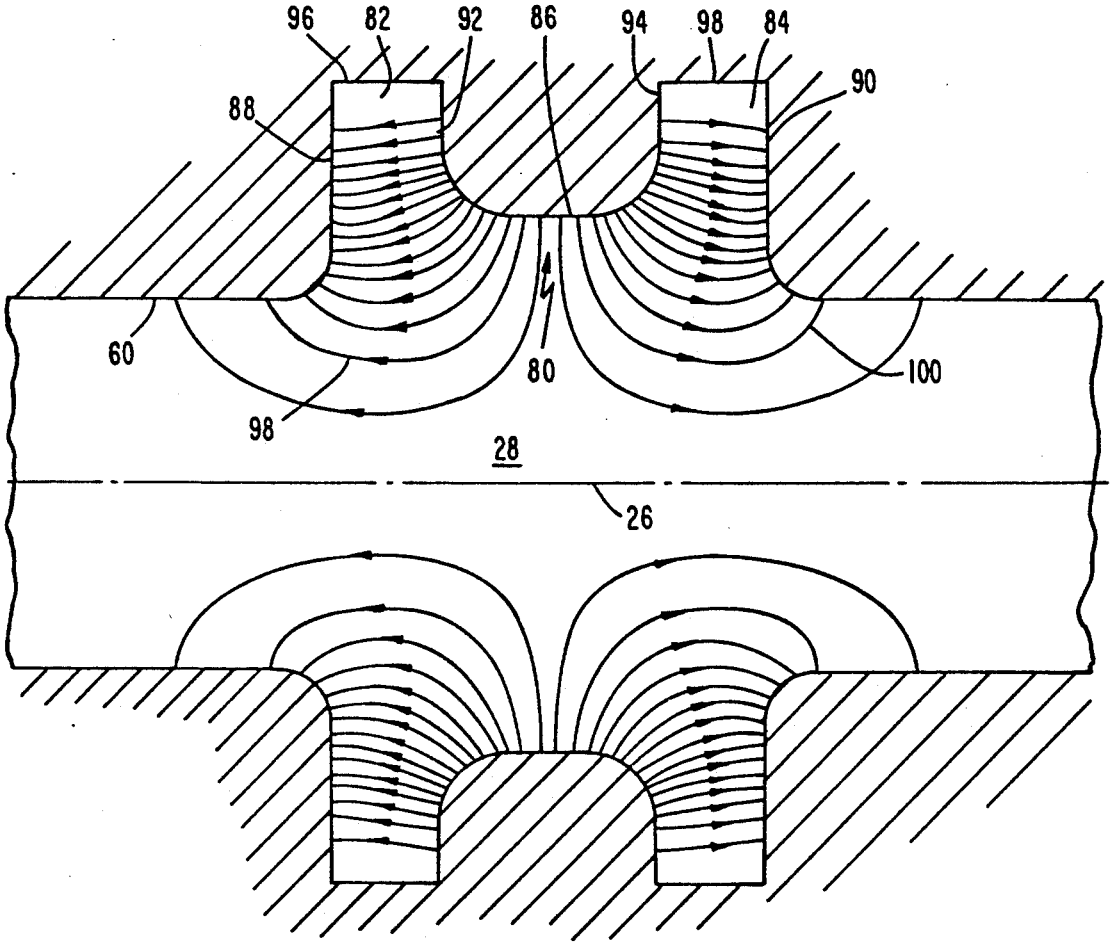
FIG. 7 is a cross-sectional view of a further resonant output coupling cavity structure that can be employed in the tube of FIG. 1.
Figure 8:
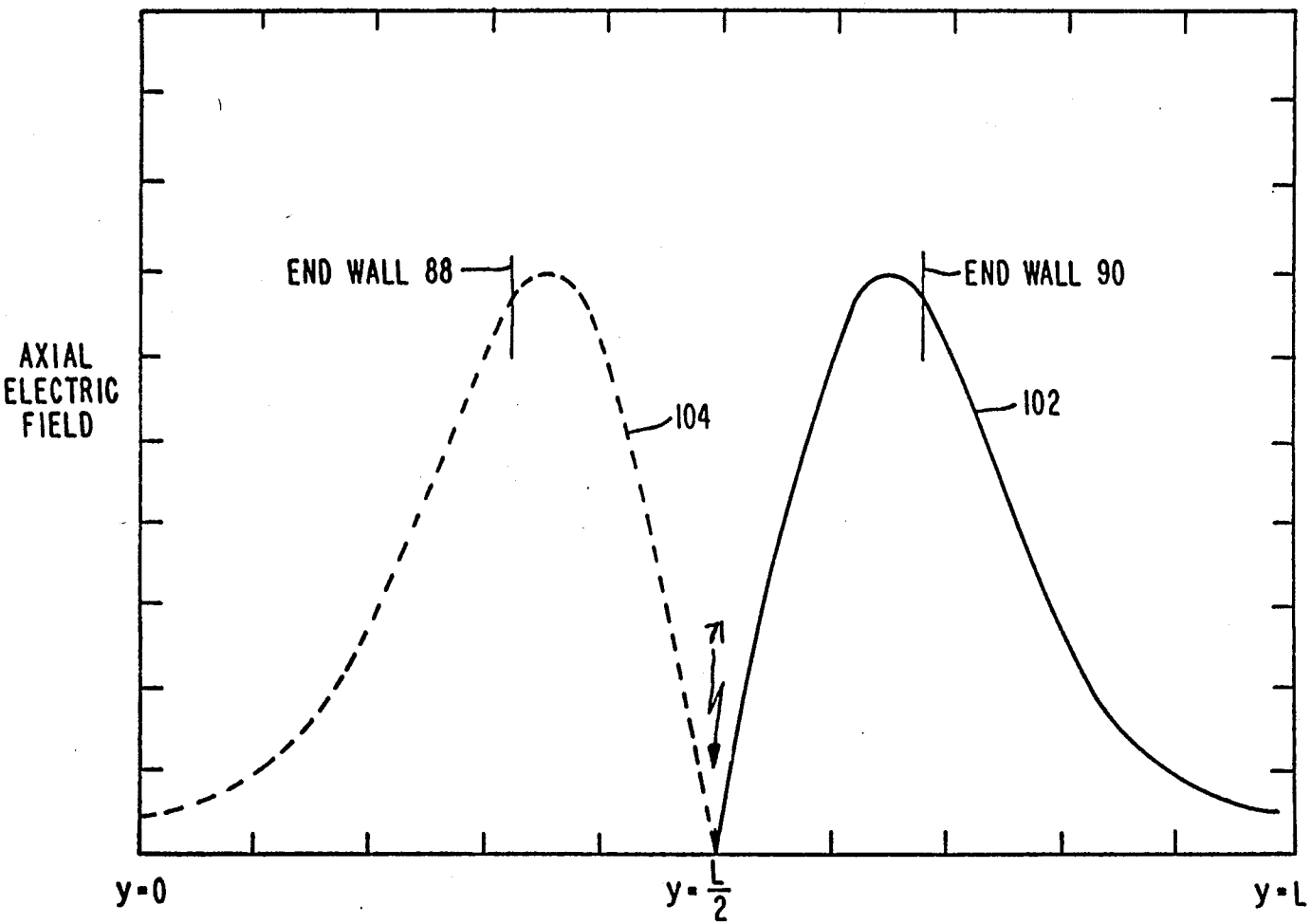
FIG. 8 is a plot of axial electric field magnitude versus axial distance for the structure illustrated in FIG. 7.

Electric field lines 98 and 100 are developed in the $TM_{011}$ excited cavity of FIG. 7. The amplitude of the axial electric field in the cavity illustrated in FIG. 7, as a function of axial position of the cavity and tunnel 20, is indicated by curves 102 and 104, FIG. 8. Curves 102 and 104 are very similar to curves 72 and 74 of FIG. 6. The curves in both figures go through a full 360° cycle range, starting at a relatively low, virtually null, negative value on tunnel wall 60 beyond, i.e. outside, a first cavity end wall, going to a negative peak between the first end wall and the center point along the cavity side wall, thence through a zero at the center of the cavity, to a positive peak between the center point and a second end wall and returning to a slightly positive, almost null value beyond the second end wall on tunnel wall 60. Curves 102 and 104 are symmetrical about the center point of cavity 80.

An inspection of FIG. 7 indicates that electric field lines 98 and 100 extend over a considerably smaller volume than the corresponding electric field lines 70 and 80 in the embodiment of FIG. 5. This factor enables the characteristic impedance of the resonant cavity illustrated in FIG. 7 to be increased relative to the characteristic impedance of the resonant cavity illustrated in FIG. 5. In addition, the resonant frequency of the structure illustrated in FIG. 7 is reduced relative to the resonant frequency of the cavity illustrated in FIG. 5, assuming that both cavities have the same axial lengths. The peripheral volume of the structure illustrated in FIG. 7 is less than the peripheral volume of the resonator illustrated in FIG. 5.

These advantages occur because of indented side wall segment 86. They are achieved because of the dominant magnetic field in the edge region of the side wall and the dominant electric field in the center region of the side wall. The reduction in resonant frequency of the cavity illustrated in FIG. 7 relative to the cavity illustrated in FIG. 5, without changing the length of the cavity, is very important to reduce the spacing between the field peaks, in terms of electronic phase shift in the beam, to provide increased interaction with the electron beam.

Figure 9:
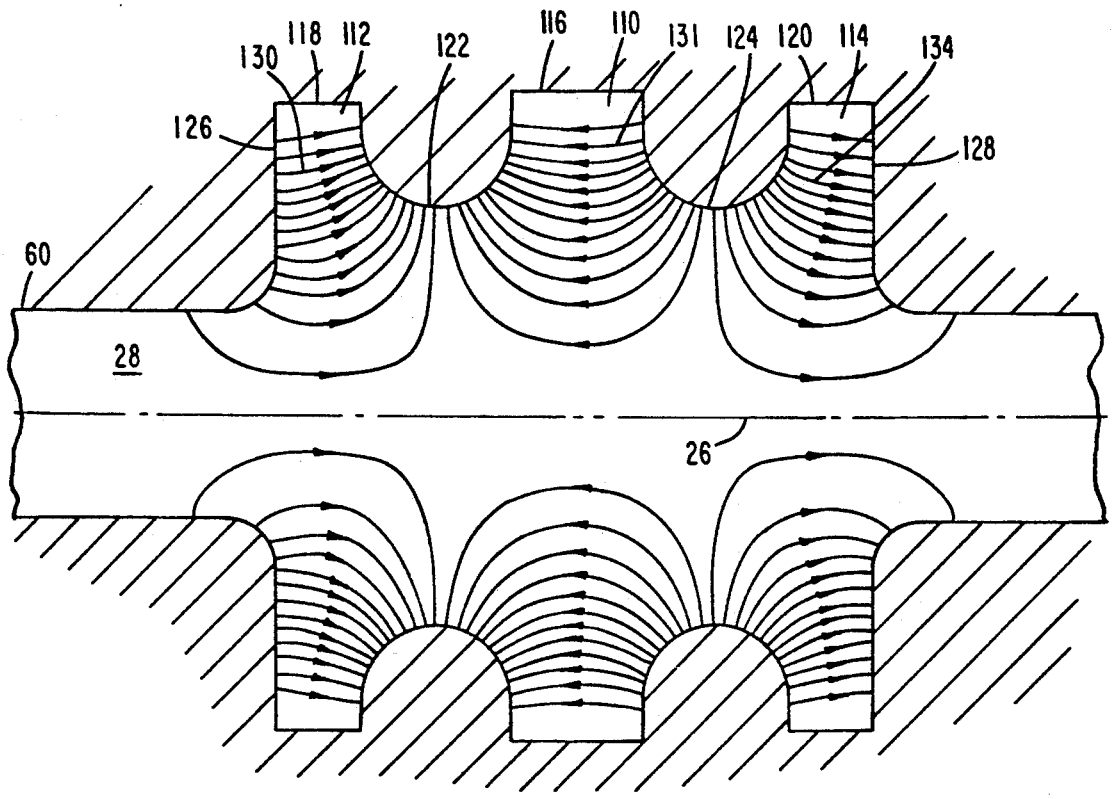
FIG. 9 is a cross-sectional view of a further embodiment of a resonant output coupling cavity that can be used in the tube illustrated in FIG. 1.

FIG. 9 is a cross-sectional view of another preferred configuration of output cavity 18 that can be employed as cavity 18 in the klystron of FIG. 1. The resonant output cavity illustrated in FIG. 9 includes center section 110 and outer sections 112 and 114, arranged so that the cavity operates in the $TM_{012}$ mode for the frequency of oscillator 22. Sections 110, 112 and 114 respectively include peripheral, cylindrical side wall segments 116, 118 and 120, arranged so that the axial lengths of walls 118 and 120 are approximately the same and one-half that of wall segment 116. Side wall segments 116 and 118 are connected together by curved side wall segment 122, while side wall segments 116 and 120 are connected together by curved side wall segment 124. The cavity illustrated in FIG. 9 includes end walls 126 and 128, that extend radially between beam tunnel wall 60 and cylindrical side wall segments 118 and 120, respectively. The minimum radii of curved side wall segments 122 and 124 are between the radii of cylindrical side walls 116, 118 and 120 and the radius of tunnel wall 60. In one preferred embodiment, the radii of wall segments 116, 118 and 120 equal R, the minimum radii of wall segments 122 and 124 equal 2R/3, and the radius of tunnel wall 60 is R/3.

There are several similarities and differences between the electric field lines of the structures illustrated in FIGS. 7 and 9. In both structures, there are substantially axial electric field lines within the sections and there are substantial electric field components extending into electron beam tunnel 28. The structure of FIG. 9 has three electric field peaks extending over a longer axial length than the two peaks of the FIG. 7 structure. In addition, the magnitude of the electric field in each section of the FIG. 9 structure is smaller than in the sections of the FIG. 7 structure for a required resonator r.f. voltage so the electric field at the resonator surfaces is reduced to decrease the tendency for electrical breakdown.

Electric field lines 130, 132 and 134 are developed in the $TM_{012}$ resonant cavity of FIG. 9. Electric field lines 130 and 134 have the same polarity, which is reversed relative to the polarity of electric field lines 132. There are nulls in the electric field approximately at the midpoints of wall segments 122 and 124, and the electric fields at end walls 126 and 128 are about 88% of the peak electric fields in sections 112 and 114.

Figure 10:
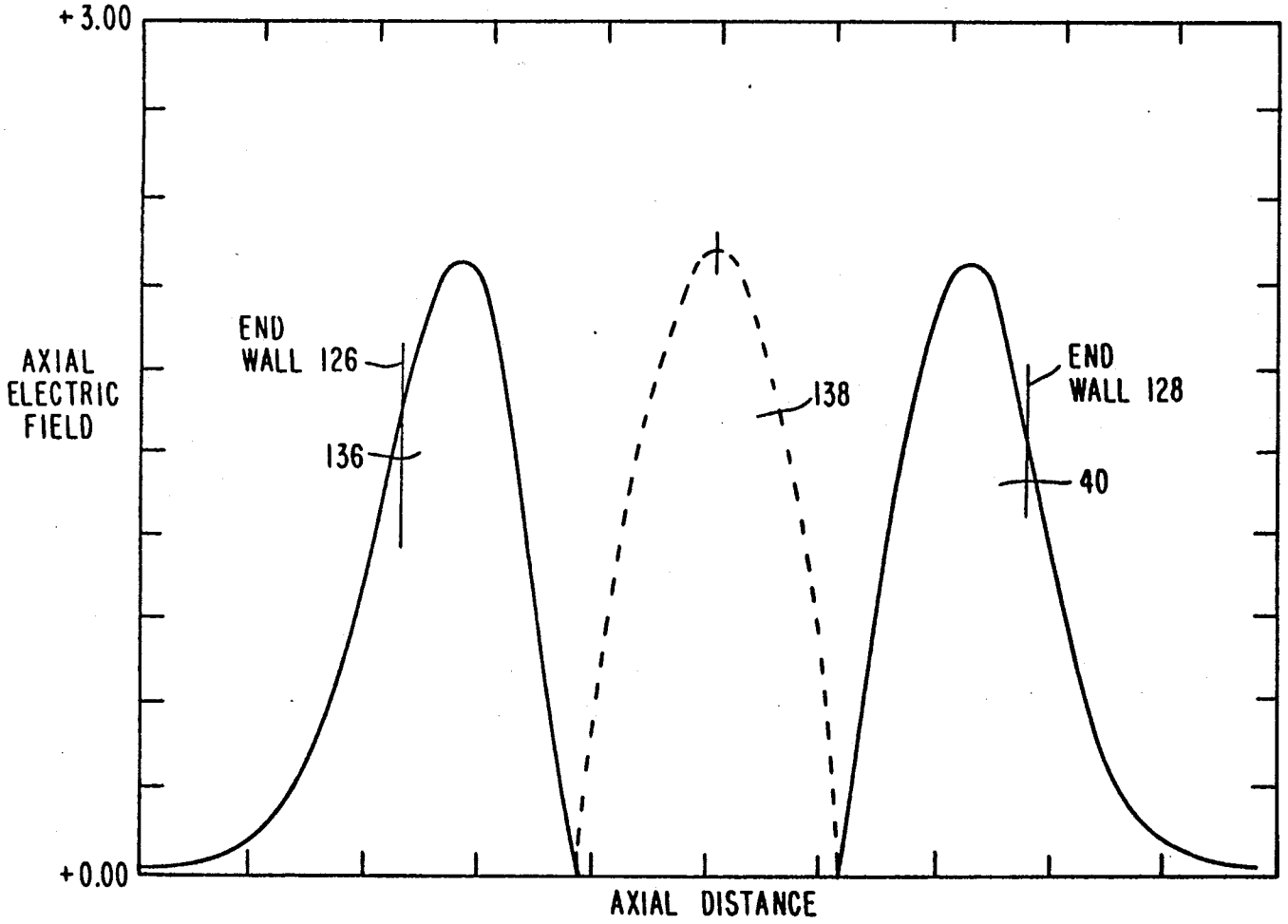
FIG. 10 is a plot of axial electric field versus axial distance for the structure illustrated in FIG. 9.

The amplitude of the electric fields as a function of distance along the axial length of the cavity of FIG. 9 is illustrated in FIG. 10 by curves 136, 138 and 140 for electric field lines 130, 132 and 134, respectively. Each of curves 136, 138 and 140 has approximately the same peak amplitude, although the peak amplitudes of curves 136 and 140 are slightly less than the peak amplitude of curve 138 because all of side wall segments 116, 118 and 120 have the same radius. A null subsists at the intersection of curves 136 and 138 while a second null is at the intersection of curves 138 and 149; the nulls are about halfway along the axial lengths of side wall segments. Curves 136 and 140 are basically mirror images of each other, while curve 138 is symmetrical about its peak value at the axial center of resonator 110, which coincides with the axial center of side wall segment 116.

To equalize the magnitude of the three electric fields in the structure illustrated in FIG. 9, or to otherwise control the peak amplitudes of the electric fields of such a structure, the radii of cylindrical wall segments 118 and 120 are changed relative to the radius of cylindrical wall segment 116. In the particular embodiment of FIG. 11, radii $a_1$ and $a_3$for wall segments 118 and 120 are equal to each other and slightly less than the radius, $a_2$, of wall segment 116 such that the magnitude of the electric fields for sections 112 and 114 is equal to the magnitude of the electric field for cell 110.

Figure 11:
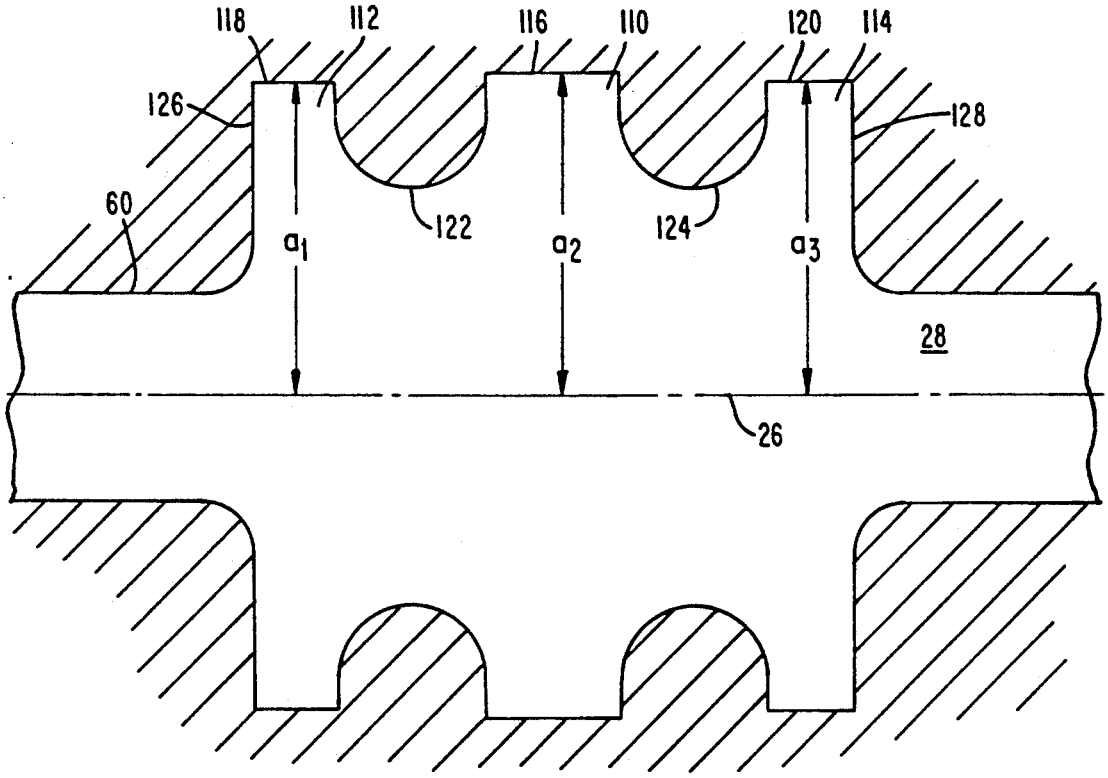
FIG. 11 is a modification of the structure illustrated in FIG. 9, wherein one of plural sections of the resonant cavity structure has a radius different from the radii of the remaining sections.
Figure 12:
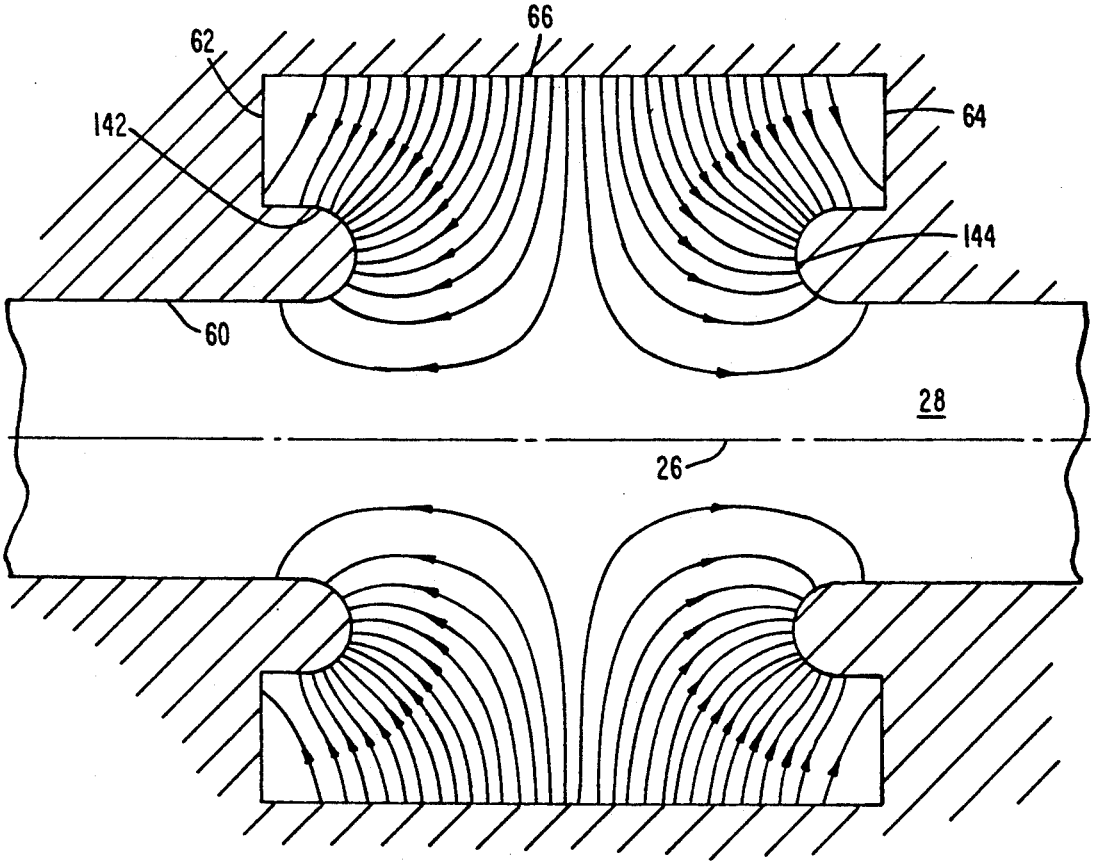
FIG. 12 is a modification of the structure illustrated in FIG. 5.

The structures of FIGS. 2, 5, 7, 9 and 11 can be modified to provide drift tips to concentrate the electric fields. FIG. 12 is an illustration of a modification of the structure illustrated in FIG. 5, to include drift tips 142 and 144 at the intersections of tunnel wall 60 and end walls 62 and 64. Drift tips 142 and 144 are configured in the usual manner, as axially extending facing hemispheres.

Figure 13:
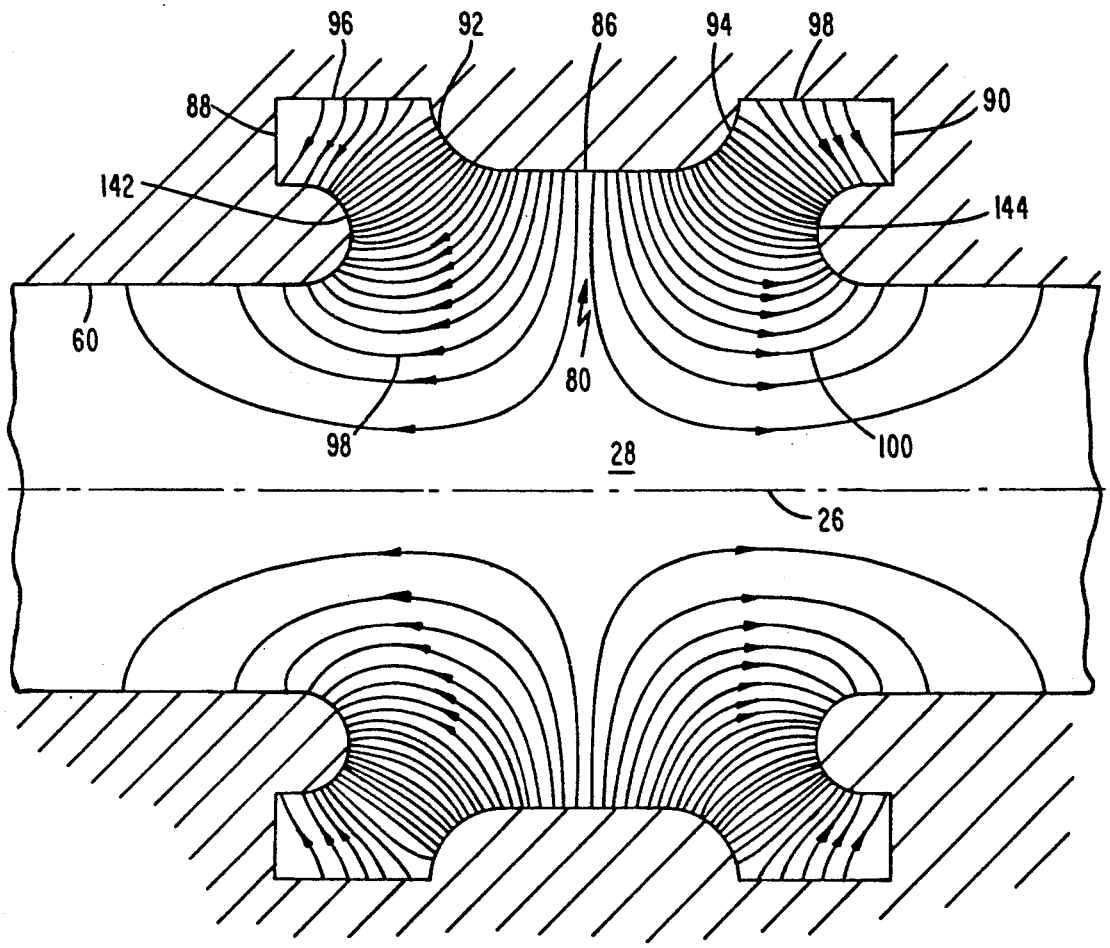
FIG. 13 is a modification of the structure illustrated in FIG. 12.

FIG. 13 is a cross-sectional view of a structure of the type illustrated in FIG. 7, with the inclusion of field concentrating drift tips 142 and 144.

Figure 14:
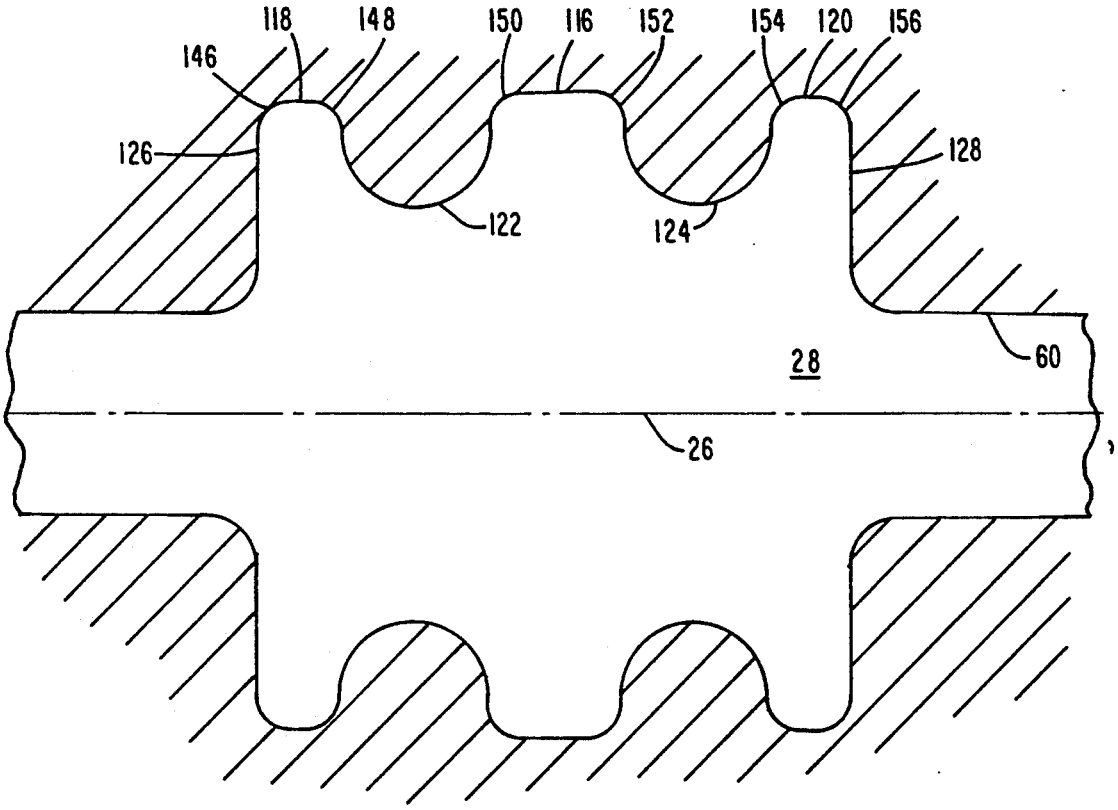
FIG. 14 is a modification of the structure illustrated in FIG. 2.

To reduce RF resistive losses and increase the Q of the resonator, the corners of the various resonators between the side and end walls, as well as between the side and intermediate walls, are curved as illustrated in FIG. 14. In the specific embodiment of FIG. 14, the structures of any of FIGS. 2, 9 or 11 are modified to include rounded corners 146, 148, 150, 152, 154 and 156, which can be formed as fillets. Rounded corners 146 and 156 are provided between end walls 126 and 128 and cylindrical side walls 118 and 120, respectively; rounded corners 148 and 150 are provided between side wall segments 118 and 116 and 122, respectively; and rounded corners 152 and 154 are provided between cylindrical side wall segments 116 and 120 and side wall segment 124, respectively.

The structure of FIG. 2 is configured in accordance with the cross-sectional view of FIG. 11 in that the radii of cylindrical side walls 37 and 41 of sections 36 and 40 are less than the radius of cylindrical side wall 39 of section 38, to equalize the amplitude of the electric field in each section. The structure operates in the $TM_{012}$ mode and has a total axial length (L) between end walls 43 and 45, which is less than λ, where λ is the free space wavelength of the output of oscillator 22. In general, resonators in accordance with the present invention have an axial length smaller than xλ/2, for the $TM_{01x}$ mode. The structure illustrated in FIG. 2 has an average radius of $(a_1+a_2+a_3/3)$, where $a_1$, $a_2$ and $a_3$are respectively the radii of cylindrical side walls 37, 39 and 41. The average radius of walls 37, 39 and 41 is between 0.425λ and 0.6λ. In contrast, conventional resonators operating in the $TM_{010}$ mode incorporated in prior art super-power klystrons have outer radii less than 0.385λ, while resonant cavities operating in the $TM_{020}$ mode have outer radii less than 0.875λ. The relatively large resonator diameter of the present invention avoids problems of the prior art in which the electron beam tunnel diameter is a higher percentage of the resonator diameter.

While there have been described and illustrated several specific embodiments of the invention, it will be clear that variations in the details of the embodiments specifically illustrated and described may be made without departing from the true spirit and scope of the invention as defined in the appended claims.

I claim:

1. A super-power, high voltage klystron tube comprising an electron gun for emitting an electron beam, an input cavity coupled to the beam, a drift region downstream of the input cavity through which the beam travels, an output cavity downstream of the drift region coupled to the beam, intermediate resonant cavity means between the input and output cavities, a collector for the electron beam downstream of the output cavity, the output cavity being configured relative to the frequency of oscillations induced in the beam so the cavity operates in the $TM_{01x}$ mode, where x is greater zero.

2. The klystron of claim 1 wherein the tube includes an electron beam tunnel surrounded by the output cavity, the output cavity including first and second adjacent sections in which oppositely directed axial electric field components are derived, the first and second sections having maximum radii greater than that of the beam tunnel and being connected together by a wall having a minimum radius between the radius of the tunnel and the maximum radii.

3. The klystron of claim 2 wherein the tunnel and output cavity are cylindrical.

4. The klystron of claim 1 where x=1.

5. The klystron of claim 1 where x=2.

6. The klystron of claim 1 wherein the output cavity is configured to establish first, second and third separate axial electric field components in the axial direction of the electron beam, the second component being between the first and third components, the first and third components having the same phase which is displaced in phase 180° from the phase of the second component.

7. The klystron of claim 6 wherein the tunnel and output cavity are cylindrical.

8. The klystron of claim 6 wherein the tube includes an electron beam tunnel surrounded by the output cavity, the output cavity including first, second and third adjacent sections in which the first, second and third components are respectively derived, the first, second and third sections having maximum radii greater than that of the beam tunnel and being connected together by a wall having a minimum radius between the radius of the tunnel and the maximum radii.

9. The klystron of claim 8 wherein the tunnel and output cavity are cylindrical.

10. The klystron of claim 1 wherein the total length of the output cavity in the axial direction of the electron beam is less than xλ/2, where λ is the wavelength of oscillations induced in the output cavity by the electron beam.

11. A super-power, high voltage klystron tube comprising an electron gun for emitting an electron beam, an input cavity coupled to the beam, a drift region downstream of the input cavity through which the beam travels, an output cavity downstream of the drift region coupled to the beam, a collector for the electron beam downstream of the output cavity, intermediate resonant cavity means between the input and output cavities, the output cavity being configured relative to the frequency of oscillations induced in the beam so the cavity includes a pair of oppositely directed electric field components in the axial direction of the electron beam.

12. The klystron of claim 11 wherein said output cavity includes means for coupling energy associated with one of the electric components to an external device.

13. The klystron of claim 11 wherein the oppositely directed components have adjacent electric field lines.

14. The klystron of claim 11 wherein the output cavity is configured to establish first, second and third separate axial electric field components in the axial direction of the electron beam, the second component being between the first and third components, the first and third components having the same phase which is displaced in phase 180° from the phase of the second component.

15. The klystron of claim 14 wherein the tube includes an electron beam tunnel surrounded by the output cavity, the output cavity including first, second and third adjacent sections in which the first, second and third components are respectively derived, the first, second and third sections having maximum radii greater than that of the beam tunnel and being connected together by a wall having a minimum radius between the radius of the tunnel and the maximum radii.

16. The klystron of claim 15 wherein the first and third sections have lengths in the axial direction of the electron beam about twice that of the second section.

17. The klystron of claim 16 wherein the output cavity is configured so it operates in the $TM_{01x}$ mode, where x is greater than zero, the total length of the three sections in the axial direction of the electron beam being less than xλ/2, where λ is the wavelength of oscillations induced in the output cavity by the electron beam.

18. The klystron of claim 17 wherein the first, second and third sections respectively have maximum radii of $a_1$, $a_2$ and $a_3$, at least one of $a_1$, $a_2$ and $a_3$being different from remaining values thereof to control the peak magnitudes of the three components.

19. The klystron of claim 18 wherein the average of $a_1$, $a_2$ and $a_3$is between 0.425 λ and 0.6 λ.

20. The klystron of claim 19 wherein adjacent surfaces of the sections are connected together by fillets.

21. The klystron of claim 11 wherein the tube includes an electron beam tunnel surrounded by the output cavity, the output cavity including first and second adjacent sections in which the oppositely directed axial electric field components are derived, the first and second sections having maximum radii greater than that of the beam tunnel and being connected together by a wall having a minimum radius between the radius of the tunnel and the maximum radii.

22. The klystron of claim 21 wherein the output cavity is configured so it operates in the $TM_{01x}$ mode, where x is greater than zero, the total length of the output cavity in the axial direction of the electron beam being less than $x\lambda/2$, where λ is the wavelength of oscillations induced in the output cavity by the electron beam.

23. The klystron of claim 21 wherein adjacent surfaces of the sections are connected together by fillets.

24. The klystron of claim 21 wherein the tunnel and output cavity are cylindrical.

25. The klystron of claim 11 wherein the output cavity is configured so it operates in the $TM_{01x}$ mode, where x is greater than zero, the total length of the output cavity in the axial direction of the electron beam being less than $x\lambda/2$, where λ is the wavelength of oscillations induced in the output cavity by the electron beam.

26. The klystron of claim 15 wherein the tunnel and output cavity are cylindrical.

27. A resonator comprising an electron beam tunnel, and a resonant cavity structure surrounding the tunnel, the cylindrical resonant cavity structure being configured in the $TM_{01x}$ mode for an electron beam traversing the tunnel, where x is greater than one.

28. The resonator of claim 27 wherein the cavity structure includes first and second adjacent sections in which oppositely directed axial electric field components are derived, the first and second sections having maximum radii greater than that of the beam tunnel and being connected together by a wall having a minimum radius between the radius of the tunnel and the maximum radii.

29. The resonator of claim 27 where x=2.

30. The resonator of claim 27 wherein the tunnel and cavity are cylindrical and coaxial.

31. The resonator of claim 27 wherein the cavity structure includes first, second and third adjacent sections in which first, second and third axial electric field components are respectively derived, the first, second and third sections having maximum radii greater than that of the beam tunnel and being connected together by a wall having a minimum radius between the radius of the tunnel and the maximum radii.

* * * * *